United States Patent [19]

Quartino

[11] Patent Number: 4,494,521

[45] Date of Patent: Jan. 22, 1985

[54] ARCHERY BOW HAVING BOW LIMB ASSEMBLY AND ADJUSTMENT

[75] Inventor: Miguel A. Quartino, St. Louis, Mo.

[73] Assignee: Hoyt/Easton Archery Co., Bridgeton, Mo.

[21] Appl. No.: 481,929

[22] Filed: Apr. 4, 1983

[51] Int. Cl.[3] ..... F41B 5/00

[52] U.S. Cl. ..... 124/24 R

[58] Field of Search ..... 124/23 R, 23 R, 88, 124/86, DIG. 1

[56] References Cited

U.S. PATENT DOCUMENTS

| | | | |
|---|---|---|---|
| 3,415,240 | 12/1968 | Bear | 124/23 R |
| 3,486,495 | 12/1969 | Allen | 124/24 R |
| 3,942,506 | 3/1976 | Izuta | 124/24 R |
| 3,957,027 | 5/1976 | Drake | 124/23 R |
| 3,987,777 | 10/1976 | Darlington | 124/23 R |
| 4,091,790 | 5/1978 | Hoyt | 124/24 R |
| 4,178,905 | 12/1979 | Groner | 124/23 R |
| 4,201,182 | 5/1980 | Butler | 124/24 R |

*Primary Examiner*—Richard J. Apley
*Assistant Examiner*—William R. Browne
*Attorney, Agent, or Firm*—Charles E. Markham

[57] ABSTRACT

The butt sections of the limbs of a take-down bow are loosely received in inwardly extending sockets in the ends of a bow handle section and are arranged to rock in a fore and aft direction on outer end portions of the rear socket walls. Inwardly extending T slots in the rear socket walls slidably receive headed members fixed in the bow limbs and prevent forward movement of the bow limbs. Members supported near the socket bottoms for fore and aft screw threaded adjustment receive the inner ends of the limbs, and spring pressed detents projecting centrally from the headed members snap into apertures in the rear socket walls when the inner ends of the limbs are properly inserted into the screw threadedly adjustable members.

4 Claims, 10 Drawing Figures

ARCHERY BOW HAVING BOW LIMB ASSEMBLY AND ADJUSTMENT

This invention relates to take-down bows having bow limbs detachably connected to the ends of a handle section and particularly to improved means for the assembly and the fore and aft adjustment of the bow limbs.

OBJECTS OF THE INVENTION

The primary object of the invention is the provision of a generally new and improved means for the infinately variable and independent fore and aft adjustment of the limbs of a take-down bow and for locking the limbs in an adjusted position;

A further object is to provide means for the assembly and fore and aft adjustment of the limbs of a take-down bow which is pleasing in appearance.

A still further object is to provide a take-down bow in which the bow limbs may be conveniently assembled on a handle section or removed therefrom and are prevented from kicking forward from the handle section in event of bow string breakage.

A still further object is to provide a take-down bow in which the bow limbs are slidably inserted into screw threadedly adjustable members positioned near the bottom of sockets in the ends of a bow handle section and in which spring pressed detents fixed to the bow limbs snap into apertures in the socket walls only when the bow limbs are properly inserted.

THE DRAWINGS

DESCRIPTION OF A PREFERRED FORM OF THE INVENTION

Figures 1, 2, 3, 4, 5, 6, 7, 8, 9, 10:
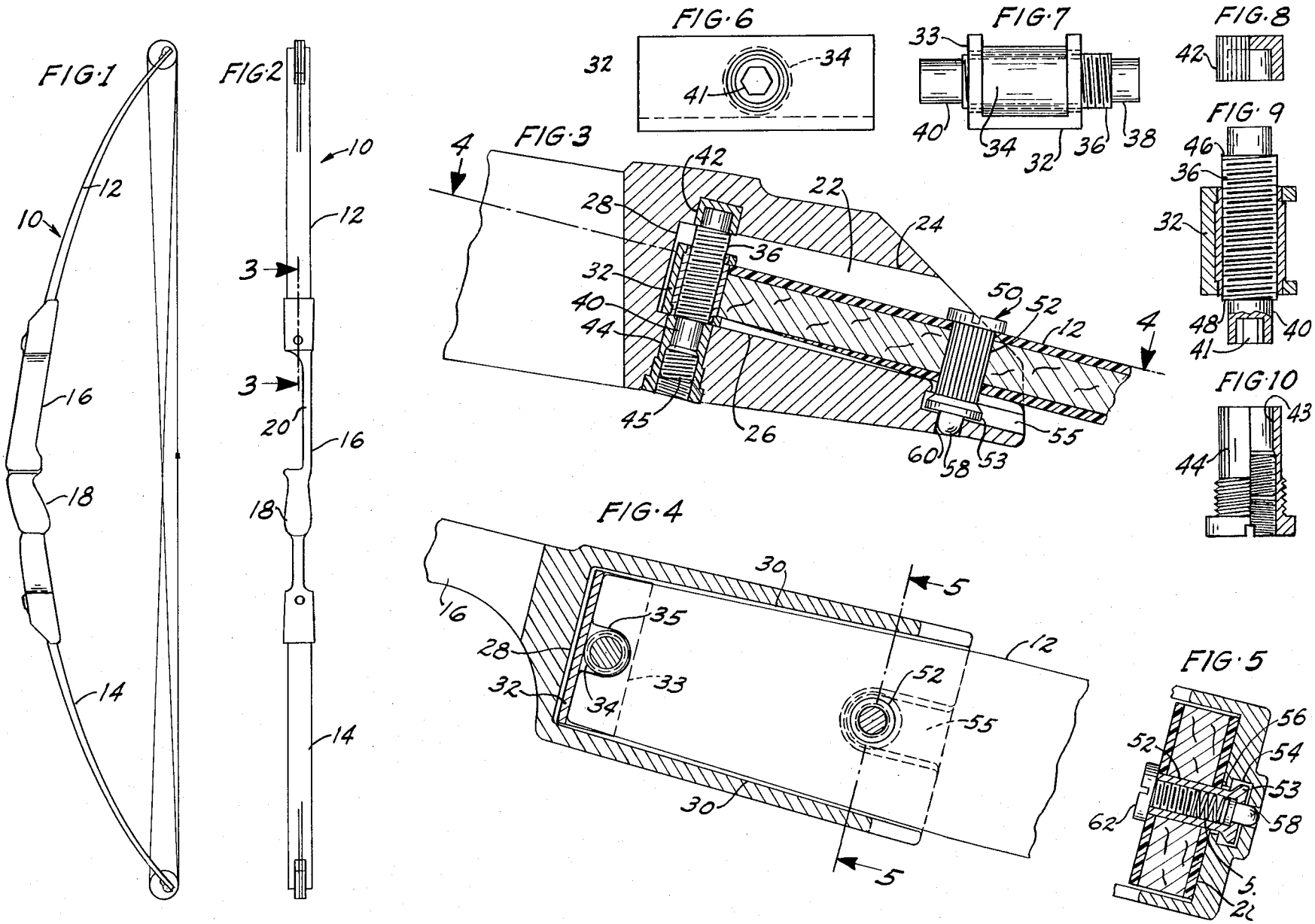
FIG. 1 is a side elevational view of a compound bow constructed in accordance with the present invention in which the bow limbs are detachably connected to the handle section and are adjustable fore and aft.
FIG. 2 is an elevational view of the bow shown in FIG. 1 viewed from the archer's side.
FIG. 3 is an enlarged fragmentary cross sectional view taken along line 3—3 of FIG. 2.
FIG. 4 is a fragmentary cross sectional view taken along line 4—4 of FIG. 3.
FIG. 5 is a fragmentary cross sectional view taken along line 5—5 of FIG. 4.
FIG. 6 is an enlarged side elevational view of the channel member with the adjustment screw.
FIG. 7 is an end elevational view of the channel member with the adjustment screw.
FIG. 8 is an enlarged, half sectionalized elevational view of the journal cap which receives one smooth end of the adjustment screw.
FIG. 9 is an enlarged longitudinal cross sectional view of the channel member with the adjustment screw.
FIG. 10 is an enlarged half sectionalized elevational view of the hollow screw which journals the other smooth end of the adjustment screw.

Referring to FIGS. 1 and 2 of the drawings, a compound type taken-down bow generally indicated at 10 is shown in a braced condition with the upper and lower limbs 12 and 14 detachably connected to a handle section 16. There are longitudinally inward extending sockets 22 generally rectangular in cross section at each end of the handle section 16 which sockets are defined by relatively short forward walls 24, relatively long rear walls 26, bottom walls 28 and side walls 30, see FIGS. 3 and 4. The bow limbs 12 and 14 are flat and rectangular in cross section and have their butt sections loosely inserted into the sockets 22.

A channel member 32 in each socket has an internally screw threaded, hollow cylindrical member 34 centrally positioned and fixed therein between it's flanges. Channel members 32 extend laterally across the sockets and are positioned closely adjacent the bottom socket walls 28 with the webs of the channel member extending parallel with the bottom socket walls. The spacing of the front and rear socket walls is greater than the width of channel members 32 so that they may be moved fore and aft therebetween. However, the spacing of the front and rear socket walls is not sufficiently greater than the width of channel members 32 to permit the inner ends of the bow limbs to be inserted between the channel members and either socket wall.

Channel members 32 are supported in position by adjustment screws 36 which extend through and are threadedly engaged in the internally screw threaded hollow cylindrical members 34. The screw threaded portions of adjustment screws 36 are greater in length than the width of channel members 32 and are provided with smooth reduced diameter end portions 38 and 40. The smooth end portions 38 are journalled in cap members 42 and the smooth end portions 40 are journalled in the reduced diameter smooth bore portions 43 of hollow screws 44. The lengths of hollow screws 44 their such that are inner ends are substantially flush with the surface of rear socket walls 26 when their outer ends are substantially flush with the exterior surface of the bow handle. The reduced diameter portions 40 at one end of adjustment screws 36 are provided with a hexagonal cavity 41, see FIG. 9, for the insertion of an Allen wrench to facillitate turning the screw. The outer end portions of hollw screws 44 are internally screw threaded to receive Allen set screws 45 for abutting the ends of ajustment screws 36 thereby to lock them in an adjusted position of channel members 32. The inner ends of the limb butt sections are slidably inserted between the flanges of channel members 32 and the inner ends of the bow limbs are provided with central, arcuate bottomed notches 35 which fittingly receive the hollow cylindrical members 34, see FIGS. 3 and 4. The inner ends of the limb butt sections when inserted into channels 32 are therefore prevented from fore and aft movement relative to the channels by their flanges and are prevented from lateral movement relative thereto by the hollow cylindrical members 34.

The butt sections of the bow limbs 12 and 14 are arranged to bear against outer end portions of the rear socket walls 26 and to rock fore and aft thereon when adjustment screws 36 are rotated so as to cause the channel members 32 and the inner ends of the bow limbs inserted therein to be moved fore and aft. The bow limbs are held against the rear socket walls by the circular heads 53 on the projecting ends of the hollow cylindrical bodies 52 of detent members generally indicated at 50. The bodies 52 of the detent members 50 have a serrated outer surface and are fixed in the bow limbs by press fitting into bores extending therethrough. The circular heads 53 are slidably entered into short inwardly extending T slots 55 in the rear socket walls. The circular heads 53 are freely received in the wider portion 54 of the T slots 55 and the lesser diameter projecting portions of bodies 52 are freely received in the narrower portions 56 of the T slots thereby to limit forward movement of the bow limbs while permitting limited rocking of the limbs on the rear socket walls.

A spring pressed element 58 longitudinally slidable in each hollow body 52 and biased outward by a spring 51 has a hemispherical end projecting centrally from the circular head 53 and is received in a round aperture 60 in the rear socket wall near the inner end of T slot 55. The longitudinal spacing of apertures 60 from channel members 32 and the longitudinal spacing of the spring pressed elements 58 from the inner ends of the bow limbs is such that only when the inner ends of the bow limbs are suitably inserted into the channel members 32 will the spring pressed elements 58 snap into the apertures 60. The ends of the hollow detent bodies 52 are closed at the head ends 53 and are closed at their other ends by headed screws 62 which retain the element biasing springs 51 therein.

The relative dimensions of the circular heads 53 on the ends of the detent bodies 56 and the wider portions 54 of the T slots is such that the heads freely fit the wider slot portions 54 thereby to permit limited rocking of the bow limbs on the outer end portions of the rear socket walls. When it is desired to adjust either bow limb in a fore or aft direction the locking set screw 45 is removed from hollow screw 44 and adjustment screw 36 is rotated by insertion of an Allen wrench in the hex socket 41. Inasmuch as adjustments of the bow limbs are invariably made when the bow is in a braced condition rotation of screws 36 will cause movement of the channel members 32 in a fore or aft direction and consequently the inner ends of the bow limbs therein and the bow limbs will bear against and rock on the rear socket walls near their outer ends at substantially the center of detent members 50. After adjustments of the bow limbs are completed the set screws 45 are inserted and tightened against the ends 40 of adjustment screws 36 thereby to lock them in an adjusted position.

When inserting the bow limbs into the sockets 22 the limb butt sections are slidably inserted along the rear socket walls so that the heads 53 of detents 50 will enter the T slots 55. Only when the inner ends of the limbs are properly inserted into the channel members 32 will the spring pressed elements snap into the apertures 60. The limbs will then be held against forward movement by the heads 53 in event of a bow string breakage and they will be held against longitudinal movement in the sockets by the spring pressed elements 58. The spacing of the front and rear socket walls 24 and 26 is sufficiently greater than the width of channel members 32 to permit fore and aft adjustment thereof. However, the spacing of the front and rear socket walls is not sufficiently greater than the width of channel members 32 to permit the inadvertant insertion of the bow limbs along one side of the channel members and to be moved inward sufficiently to register the spring pressed detent elements with apertures 60. When removing the bow limbs, the bow is first unstrung and the limbs then pulled longitudinally outward with a moderate force to disengage the spring pressed elements 58 from apertures 60.

I claim:

1. In an adjustable limb, take-down bow, an elongated handle section having a socket extending longitudinally inward at each end thereof and having spaced front and rear walls and a bottom wall, a pair of flat bow limbs having front and rear sides and having the butt sections thereof inserted into said sockets between said front and rear walls, a short T slot in each rear socket wall extending longitudinally inward from its outer end, a member fixed in each butt section and having an enlarged head projecting from the rear side thereof slidably inserted in said T slots whereby said bow limbs are restrained from kicking forward, the spacing of said front and rear socket walls being substantially greater than the thickness of said limb butt sections and said enlarged heads being loosely received in said T slots whereby said butt sections may rock on said rear socket walls near the outer ends thereof as the inner ends of said butt sections are adjustably moved fore and aft, a screw operated limb adjustment member positioned in each of said sockets near its bottom wall for adjustably moving the inner ends of said butt sections fore or aft comprising an operating screw journalled in said front and rear socket walls and having screw threaded engagement with said adjustment member and said adjustment member having spaced front and rear walls parallel with said front and rear socket walls and spaced so as to slidably receive and retain the inner ends of said butt sections therebetween, and a spring pressed detent element projecting centrally from each of said heads and entered into an aperture in each of said rear socket walls.

2. The adjustable limb take-down bow claimed in claim 1 in which said member fixed in each butt section and having an enlarged head projecting from the rear side of the butt section comprises a hollow cylinder fixed in a bore extending through said butt section and having an enlarged diameter head thereon projecting from the rear side of said butt section, and in which said spring pressed detent element is elongated and slidably mounted in said hollow cylinder, and has a hemi-spherical outward end portion which is speing biased outwardly from said head.

3. The adjustable limb take-down bow claimed in claim 1 in which said screw operated limb adjustment members each comprise a length of channel extending parallel with said front and rear socket walls with its web facing said bottom socket wall and having spaced flanges slidably receiving and retaining the inner ends of said butt sections against fore and aft movement relative thereto, an internally screw threaded hollow cylindrical element extending between and fixed to said flanges, and an adjustment screw extending through and threadedly engaged in said hollow cylindrical element and said screw having the ends thereof journalled in said front and rear socket walls, and in which the inner ends of said limb butt sections are provided with a notch fittingly receiving said hollow cylindrical element thereby to retain said butt sections from transverse movement.

4. The adjustable limb take-down bow claimed in claim 3 in which the difference in the spacing of said front and rear socket walls and the width of said channels is less than the thickness of said limb butt sections.

* * * * *